US006379240B2

(12) United States Patent
Livchak et al.

(10) Patent No.: US 6,379,240 B2
(45) Date of Patent: Apr. 30, 2002

(54) AIR CIRCULATION SYSTEM FOR A REFRIGERATED DISPLAY CASE AND METHOD FOR VENTILATING A ROOM SPACE, HALL SPACE OR A REFRIGERATED DIVISION THEREOF HAVING A REFRIGERATED DISPLAY CASE

(75) Inventors: Andrey Livchak; Jorma Pekkinen, both of Kausala; Tuomas Moilanen, Imatra, all of (FI)

(73) Assignee: Halton Oy, Kausala (FI)

( * ) Notice: Subject to any disclaimer, the term of this patent is extended or adjusted under 35 U.S.C. 154(b) by 0 days.

(21) Appl. No.: 09/296,511

(22) Filed: Apr. 22, 1999

(30) Foreign Application Priority Data

Apr. 23, 1998 (FI) ..... 980897

(51) Int. Cl.[7] ..... F24F 9/00
(52) U.S. Cl. ..... 454/193; 62/256
(58) Field of Search ..... 454/193; 62/256, 62/428, 255; 165/48.1, 58

(56) References Cited

U.S. PATENT DOCUMENTS

| | | | | |
|---|---|---|---|---|
| 2,708,868 A | * | 5/1955 | Loomis | 454/237 |
| 3,263,745 A | * | 8/1966 | Henry | 165/48.1 |
| 3,462,966 A | | 8/1969 | Reid et al. | 62/248 |
| 3,509,834 A | * | 5/1970 | Rosenberg et al. | 110/254 |
| 4,327,869 A | * | 5/1982 | Nawa et al. | 454/284 |
| 4,519,217 A | * | 5/1985 | Phillips et al. | 62/256 |
| 4,556,172 A | * | 12/1985 | Sugawara et al. | 239/590.5 |

* cited by examiner

*Primary Examiner*—Jiping Lu
(74) *Attorney, Agent, or Firm*—Steinberg & Raskin, P.C.

(57) ABSTRACT

Air circulation system for a refrigerated display case and a method for ventilating a space including a refrigerated display case. The refrigerated display case includes a space inside a frame of the display case, shelves in the space and an inside air circulation system for circulating air from the bottom portion of the display case to the top portion of the display case. Warm air is supplied by a blower arranged in connection with the refrigerated display case and blown to the front side of the refrigerated display case in the vicinity of the floor on which the refrigerated display case is situated.

17 Claims, 4 Drawing Sheets

FIG.3A
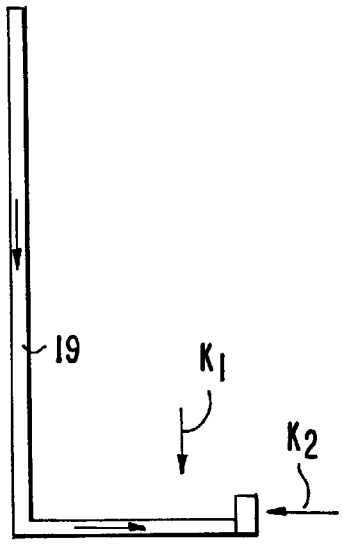
FIG.3B
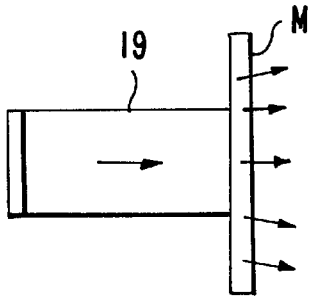
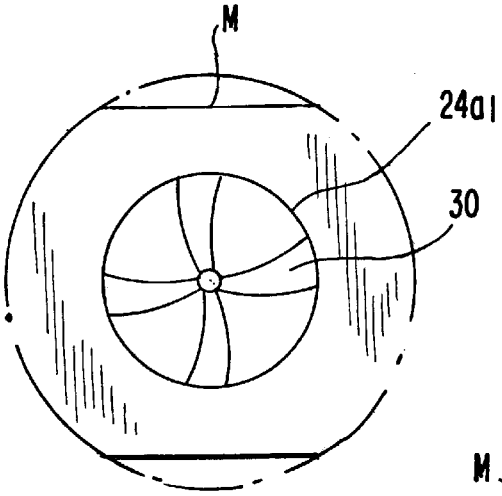
FIG.3D
FIG.3C
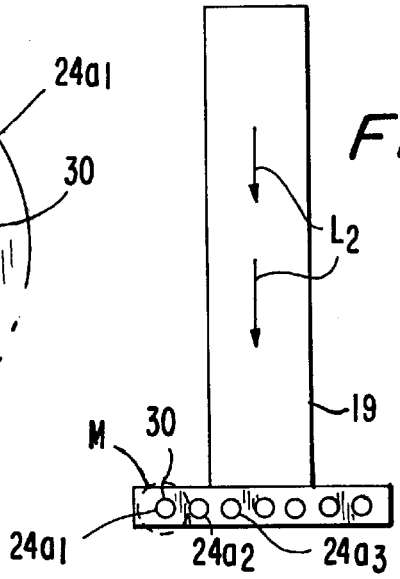

AIR CIRCULATION SYSTEM FOR A REFRIGERATED DISPLAY CASE AND METHOD FOR VENTILATING A ROOM SPACE, HALL SPACE OR A REFRIGERATED DIVISION THEREOF HAVING A REFRIGERATED DISPLAY CASE

FIELD OF THE INVENTION

The present invention relates to an air circulation system for a refrigerated display case and a method for ventilating a room space, hall space or refrigerated division in a hall space provided with one or more refrigerated display cases.

BACKGROUND OF THE INVENTION

In the prior art, constructions of refrigerated display cases are known in which the refrigerated display case is provided with an air-circulation system in the shelf space in the refrigerated display case. Air is circulated through a channel placed at the bottom and in the rear wall of the display case to the top portion of the display case and from there, the air is directed as a curtain jet to the front side of the display case and further into a channel placed in the lower part of the display case. The circulation system comprises a blower that produces the circulation flow of air as well as an air refrigerator for cooling the thus-circulating air.

A drawback in the prior art constructions of refrigerated display cases is that cold air is discharged from the shelf space of the display case into the store space and further to the vicinity of the floor level. This cold air produces a disagreeable sensation for the customers in the store when situated proximate the display case.

OBJECTS AND SUMMARY OF THE INVENTION

It is an object of the present invention to provide new and improved circulation systems for refrigeration display cases.

It is another object of the present invention to provide new and improved methods for ventilating a room space, hall space or refrigerated division of a hall space provided with one or more refrigerated display cases.

It is still another object of the present invention to avoid the drawback of prior art refrigeration display cases mentioned above.

It is yet another object of the present invention to provide new and improved combinations of a refrigerated display case and an air circulation system for circulating fresh air into a room space in which the refrigerated display case is situated.

In order to attain at least some of these objects, and others, in the present invention, a arrangement is employed separate from the circulation system of the display case yet by whose means warm air is directed from locations below the display case to the front side of the display case to the vicinity of the floor on which the display case is situated. In accordance with the present invention, a channel for the supply of warm air includes a blower arranged in connection with the refrigerated display case, in which case, air from the room is circulated by means of the blower. The blower is placed in a stationary position in connection with the refrigerated display case, and no separate pipe connections are needed for the refrigerated display case in this embodiment of the invention. After the blower, there can be a separate heater, for example an electric heater to heat the air being directing into the room space via the blower.

Within the scope of the invention, an embodiment is also possible in which, from a trunk channel, warm or heated air is passed into a channel placed in connection with the refrigerated display case and further, from below the refrigerated display case, through nozzles into the room space. In this embodiment, the entire supply of fresh air into the room space, hall space or refrigerated division in a hall space provided with a refrigerated display case preferably takes place through one or more channels placed underneath the refrigerated display case.

In accordance with the invention, pairs of refrigerated display cases can be arranged one opposite to the other. In such a case, by means of nozzles, the warm intake air is passed into the room space so that it extends as an effective flow up to the flow of warm intake air passed out of connection with the opposite refrigerated display case. By means of the nozzle, the ejecting distance of the intake air can be adjusted to the desired level so that air can be passed out of the opposite display cases so that the whole of the floor area between the display cases is covered with warm intake air.

Also, the air circulation system in accordance with the invention, which makes air flow in connection with a refrigerated display case, comprises an equipment for supply of warm air, more particularly, a blower in connection with the refrigerated display case and which is in flow communication with a channel or conduit. Air is made to flow by means of the blower out of the channel. The channel is opened at a location below the refrigerated display case. In this manner, warm air is passed to the front side of the refrigerated display case to the vicinity of the floor.

In the method in accordance with the invention for ventilation in a room space, hall space or in a refrigerated division in a hall space provided with a refrigerated display case/cases, the entire supply of fresh air into the room space, hall space or into the refrigerated division in a hall space is optimally arranged to take place from below the refrigerated display case/cases while the fresh air is passed from a trunk channel into a channel placed in connection with the refrigerated display case. The channel is opened at the bottom part of the refrigerated display case so that fresh air flows to the front side of the refrigerated display case to the vicinity of the floor.

In a combination of a refrigerated display case and supply means in accordance with the invention, the display case includes means defining an interior space, e.g., a frame, at least one shelf arranged in the interior space, and an air circulation system for circulating air in the interior space. The supply means are coupled to the display case for supplying warm air to a location in front of the display case and comprise a first channel having an outlet opening situated below the display case and a blower coupled to the first channel for directing air into the first channel and out of the outlet opening. In one embodiment, regulation means are arranged in the outlet opening of the first channel for regulating flow of the air through the outlet opening. The regulation means may comprise at least one nozzle or valve arranged to regulate a distance to which the air is ejected from the first channel. The nozzle(s) may be a slot nozzle comprising a rotatable, eccentric regulator piece arranged in opposed relationship to a curved wall whereby rotation of the regulator piece varies an opening between the regulator piece and the curved wall through which the air flows. The air circulation system is arranged to circulate air from a bottom portion of the interior space to a top portion of the interior space. Also, the air circulation system may comprise a second channel and cooling means for cooling air flowing in the second channel. In this embodiment, the combination may optionally include a first heat exchanger operative on the air flow in the first channel, and a second heat exchanger operative on the air flow in the second channel, the first and second heat exchangers being arranged to transfer energy such that the air flow in the first channel is heated as the air flow in the second channel is cooled.

An important feature of the invention is that the first channel has a vertically extending branch adapted to extend along a vertical wall of the display case and above the top of the display case. As such, the combination of the display case and supply means may be positioned flush against a wall an the intake air flow obtained from the space between the top of the display case and the ceiling of the space in which the display case is situated. The first channel would then also includes a horizontally extending branch in flow communication with the vertically extending branch and extending below the display case.

In the following, the invention will be described in detail with reference to some exemplifying embodiments of the invention illustrated in the figures in the accompanying drawing. However, the invention is by no means strictly confined to the details of the illustrated embodiments alone.

BRIEF DESCRIPTION OF THE DRAWINGS

The following drawings are illustrative of embodiments of the invention and are not meant to limit the scope of the invention as encompassed by the claims.

FIG. 3A is a side view of an intake channel used in the air circulation system in accordance with the invention.

FIG. 3B shows the intake channel as viewed in the direction of the arrow K, in FIG. 3A.

FIG. 3C shows the intake channel as viewed in the direction of the arrow $K_2$ in FIG. 3A.

DETAILED DESCRIPTION OF THE PREFERRED EMBODIMENTS

Figure 1A:
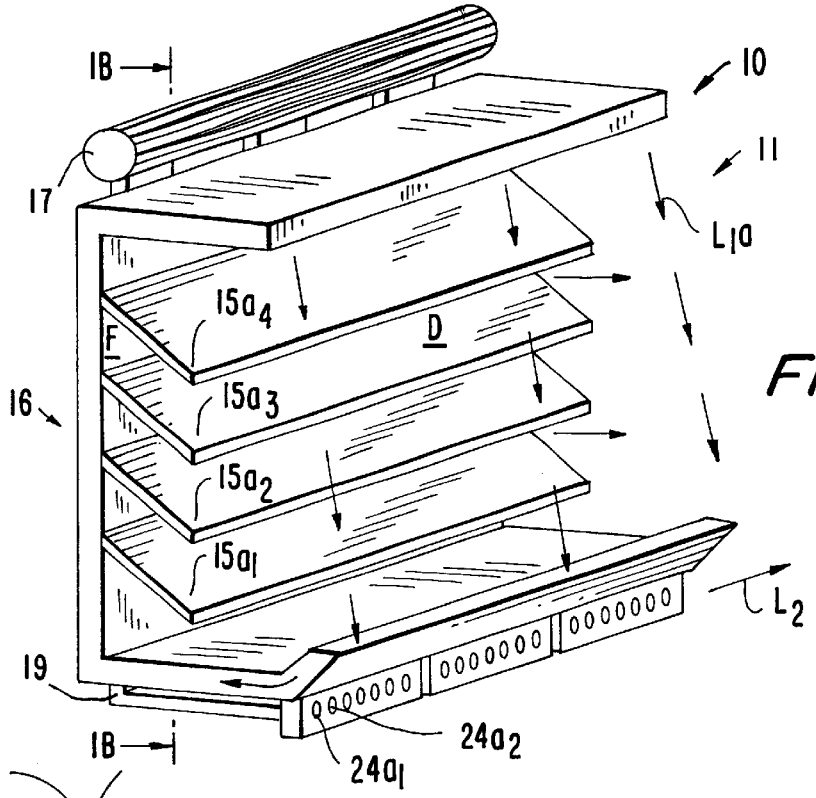
FIG. 1A shows a refrigerated display case in accordance with the invention, which is provided with an air circulation system in accordance with the invention.
Figure 1B:
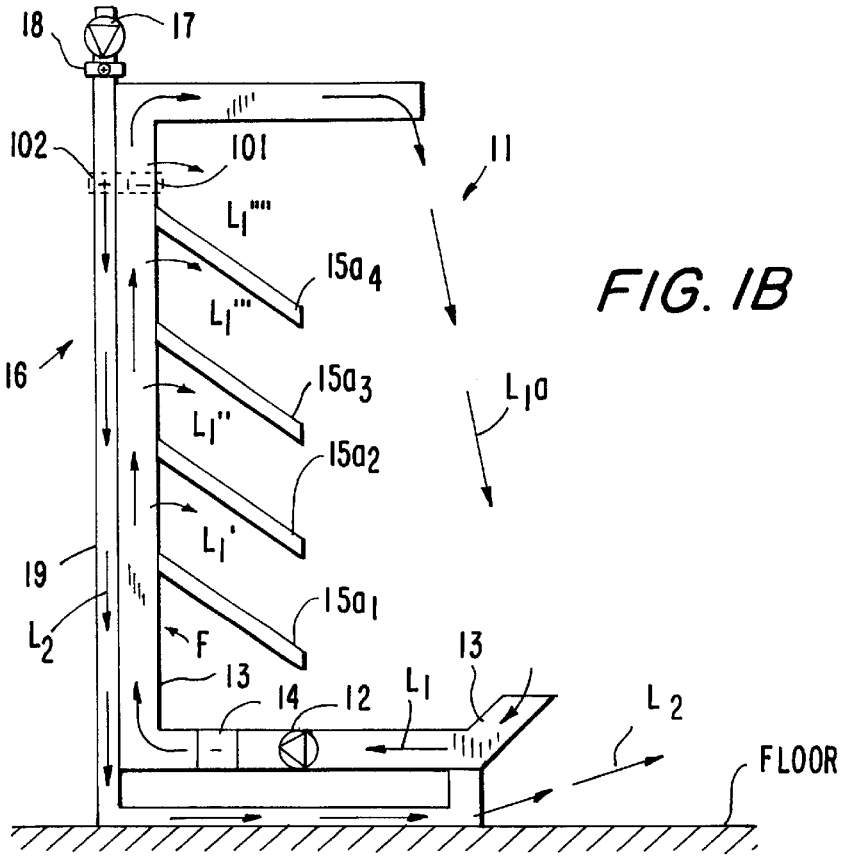
FIG. 1B is a cross-sectional view taken along the line 1B—1B in FIG. 1A.

Referring to the accompanying drawings wherein the same reference numerals refer to the same or similar elements, FIG. 1A is a perspective, schematic illustration of a refrigerated display case 10 in accordance with the invention and FIG. 1B is a sectional view taken along the line 1B—1B in FIG. 1A. The refrigerated display case 10 comprises an air circulation system 11 in the interior thereof. The air circulation system 11 comprises a blower 12 for imparting movement to air, an air channel 13 in which the blower 12 is situated and a heat exchanger 14 operative at a location in the air channel 13 after blower 12 in the moving direction of the air (FIG. 1B). Instead of blower 12, other means for imparting movement to the air in channel 13 can be provided. Also, the position of blower 12 in channel 13 as shown is not limiting and the blower 12 may be situated elsewhere in channel 13. Further, channel 13 may be formed from a single passage-defining component or multiple components in flow communication with one another.

As indicated by the arrows $L_1$, air is circulated through the air channel 13 to the top portion of a shelf space D in the refrigerated display case 10, and air is also discharged from a rear wall F of the shelf space D directly into connection with shelves 15$a_1$, 15$a_2$, 15$a_3$, 15$a_4$. The air is discharged from the top portion of the shelf space D as curtain jets $L_{1a}$ in the vicinity of the front wall of the refrigerated display case 10 (not shown). Through the channel 13 which has an inlet opening at the bottom portion of the display case 10 and by means of a circulation of air produced by the blower 12, air is circulated through the heat exchanger 14 and cooled thereby. The cooled air is forced up, e.g., by the effect of blower 12, through the channel 13 running along the rear wall F of the space D to the top portion of the space D, where the cold air is discharged into the space D. Component flows $L_1'$, $L_1\Delta$, . . . of cold air are directed into connection with the shelves 15$a_1$, 15$a_2$, . . . , i.e., over the shelves, out of a vertical portion of the channel 13 through flow openings or flow nozzles 13$a_1$, 13$a_2$, . . . The rear wall F of the space D can be formed by a panel defining the channel 13.

In accordance with the embodiment of the invention shown in FIGS. 1A and 1B, the air circulation system comprises supply means 16 for supplying intake air in connection with the refrigerated display case 10, more specifically to a location in front of the refrigerated display case 10. The supply means 16 comprises a blower 17 arranged in connection with the refrigerated display case 10 and an intake air channel 19. Blower 17 is arranged to blow air from the room from a location above the display case 10 or air that has been heated into the channel 19. Channel 193 includes a vertically extending branch adapted to be situated alongside a vertical wall of the display case 10 and a horizontally extending branch adapted to be situated below the display case 10. Optionally, a heat exchanger 102 (dashed lines) or an electric heater 18 is arranged in the channel 19 to heat the air drawn into the channel 19 by blower 17. The air is passed out of the channel 19 into the room space H through nozzles or valves 24$a$ in the outlet opening of channel 19 to locations below the display case 10 (FIG. 1A). In the illustrated embodiment, the flow of air blown from the bottom portion of the display case is denoted by arrows $L_2$.

Instead of blower 17, other means for imparting movement of air into and through channel 19 can be provided. Also, the position of blower 17 at the top of the vertically extending branch of channel 19 is not limiting and the blower 17 may be situated elsewhere in channel 19. Further, channel 19 may be formed from a single passage-defining component or multiple components in flow communication with one another to define a flow passage from an inlet at the top of vertically extending branch of channel 19 to the nozzles or valves 24$a$ in the outlet opening of the channel 13.

As shown in FIG. 1B, the blower 17 for producing the flow of air is placed directly in connection with the refrigerated display case 10 above the top of the display case 10 and connected with the display case 10. In order that the air should be appropriately warm, the air can be heated to a desired temperature by means of the heat exchanger 102 or, preferably by means of the electric heater 18, which is associated with the channel 19 and operative on the air flowing therethrough. In the embodiment shown in FIG. 1B, the blower 17 draws or sucks air out of the room space H. However, an embodiment is also possible in which the suction side of the blower 17 is connected to a trunk channel 21 for fresh intake air (FIG. 2).

The dashed lines in FIG. 1B illustrate a heat exchanger construction in which heat is transferred from a heat exchanger 101 arranged in channel 13 to the heat exchanger 102 in channel 19. The heat exchanger 101 is placed at the cold side, and its function is to cool the air that is circulated in the circulation within the refrigerated display case 10, and the heat is transferred from the heat exchanger 101 to the heat exchanger 102 in order to heat the air in the channel 19. Thus, heat is transferred from the air that flows in the channel 13 into the air that flows in the channel 19. The system is thus quite economical.

Figure 2:
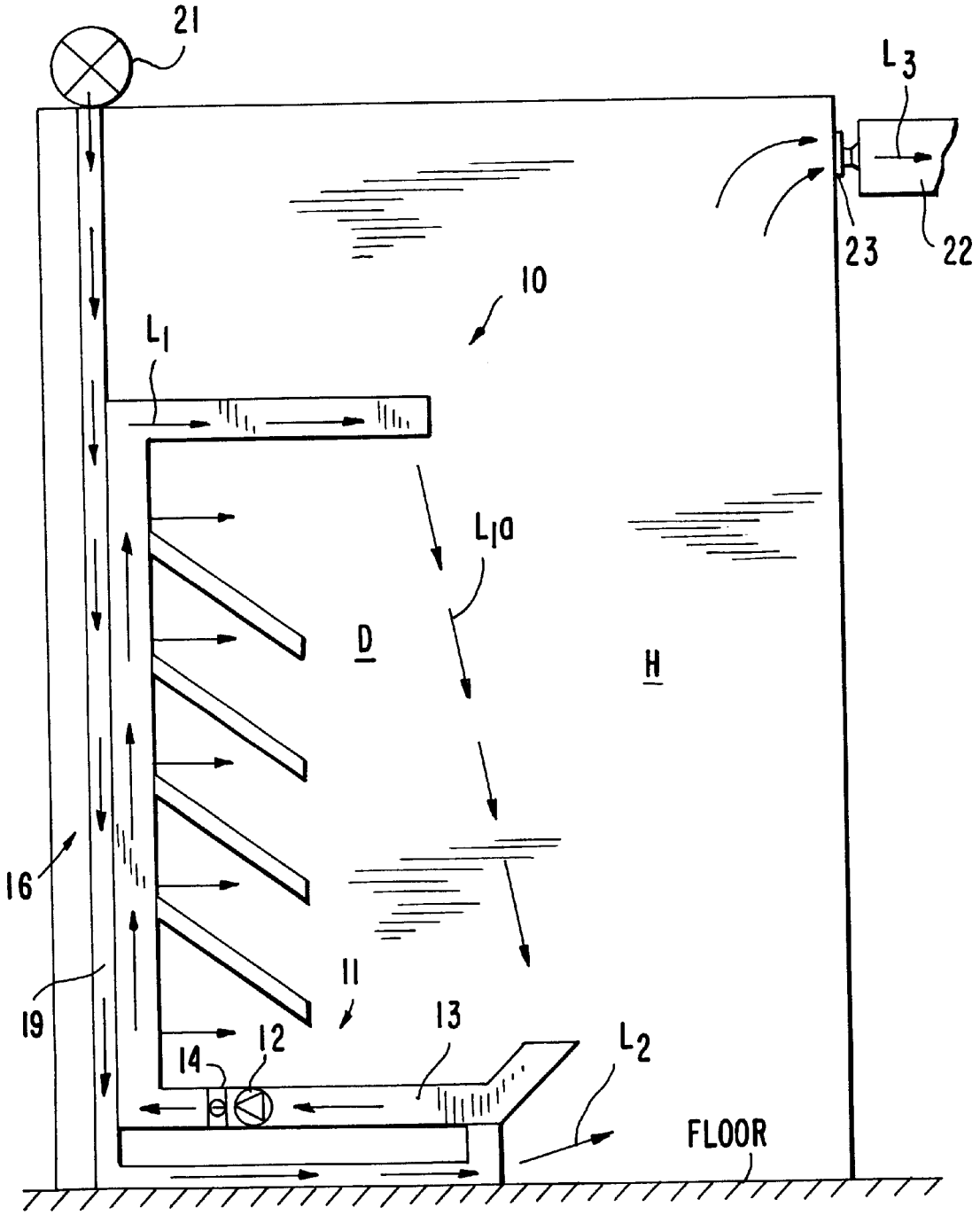
FIG. 2 shows another embodiment of a refrigerated display case in accordance with the invention situated in a room space.

FIG. 2 shows a refrigerated display case 10 in accordance with the invention as positioned in a room space, a hall space or in a refrigerated division in a hall space H. Fresh air is passed into the channel 14 in the refrigerated display case 10 directly from the trunk channel 21 placed in the vicinity of a ceiling K of the room space or the refrigerated division H. The entire supply of fresh intake air into the room space or the refrigerated division H is preferably arranged by means of the system in accordance with the invention. In this case, the entire fresh intake air for the room, the hall space, or for the refrigerated division, which fresh intake air can be heated or which can be passed directly from outdoors, for example, in the summer time without heating, is passed into the room space through the channel 19 and discharged to the front side of the display case/cases.

Air is passed out of room space or hall space H into an air exhaust channel 22 which includes an exhaust air valve 23, which is opened into the room space or hall space H at a top portion of the space. Thus, the supply of fresh air for substantially the entire room space or hall space or refrigerated division H takes place exclusively through the supply of air through the bottom portion of the refrigerated display case/cases 10. The discharge of air takes place through the exhaust air valve 23 and through the exhaust channel 22. The discharge air flow $L_3$ is produced by a blower optionally arranged in the exhaust channel 23 and the intake air flow is produced by a blower optionally arranged in the channel 19 or trunk channel 21. In the embodiment shown in FIG. 2, the blower for the intake air flow can be substituted for by a blower 17 connected with the refrigerated display case 10.

FIG. 3A is a side view of the intake air channel 19 incorporated into the display case 10 (without the blower 17 and heater 18).

FIG. 3B shows the intake air channel 19 as viewed in the direction of the arrow $K_1$ in FIG. 3A, i.e., from the top.

FIG. 3C shows the intake air channel 19 as viewed in the direction of the arrow $K_2$ in FIG. 3A. As shown in FIG. 3C, the air (arrow $L_2$) is passed into an air chamber M placed at the end of the horizontal branch of channel 19 and branched to the nozzles or valves 24$a_1$, 24$a_2$ . . . which can be preferably valves provided with a wing rim (not shown), which produces vortex formation in the flow.

Figure 4B:
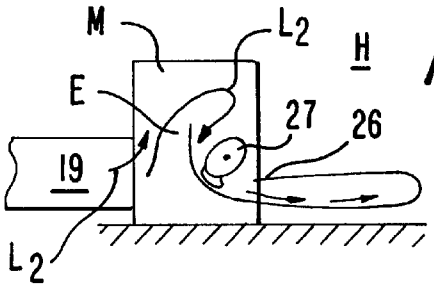
FIG. 4B is a sectional view taken along the line 4B—4B in FIG. 4A.
Figure 4A:
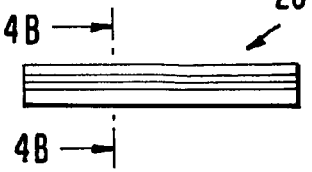
FIG. 4A shows a slot-like nozzle construction.

FIG. 4A shows an embodiment of the invention in which the channel 19 terminates in a slot nozzle 25 including at least one nozzle slot 26.

FIG. 4B is a sectional view taken along the line 4B—4B in FIG. 4A. The air flow taking place through the nozzle slot 26 is regulated by means of an oblong regulator piece 27 placed in the chamber M. The regulator piece 27 is an eccentric piece, which can be rotated into different positions of regulation relative to a curved air-flow guide face E in the chamber M to thereby enable adjustment of the flow through nozzle slot 26. Thus, depending on the position of the regulator piece 27, it is possible to regulate, e.g., the ejecting distance of the air discharged from the chamber M. Other means for regulating the flow of air through the outlet opening of the channel 19, e.g., the ejecting distance, rate or volume, can also be provided.

Figure 5:
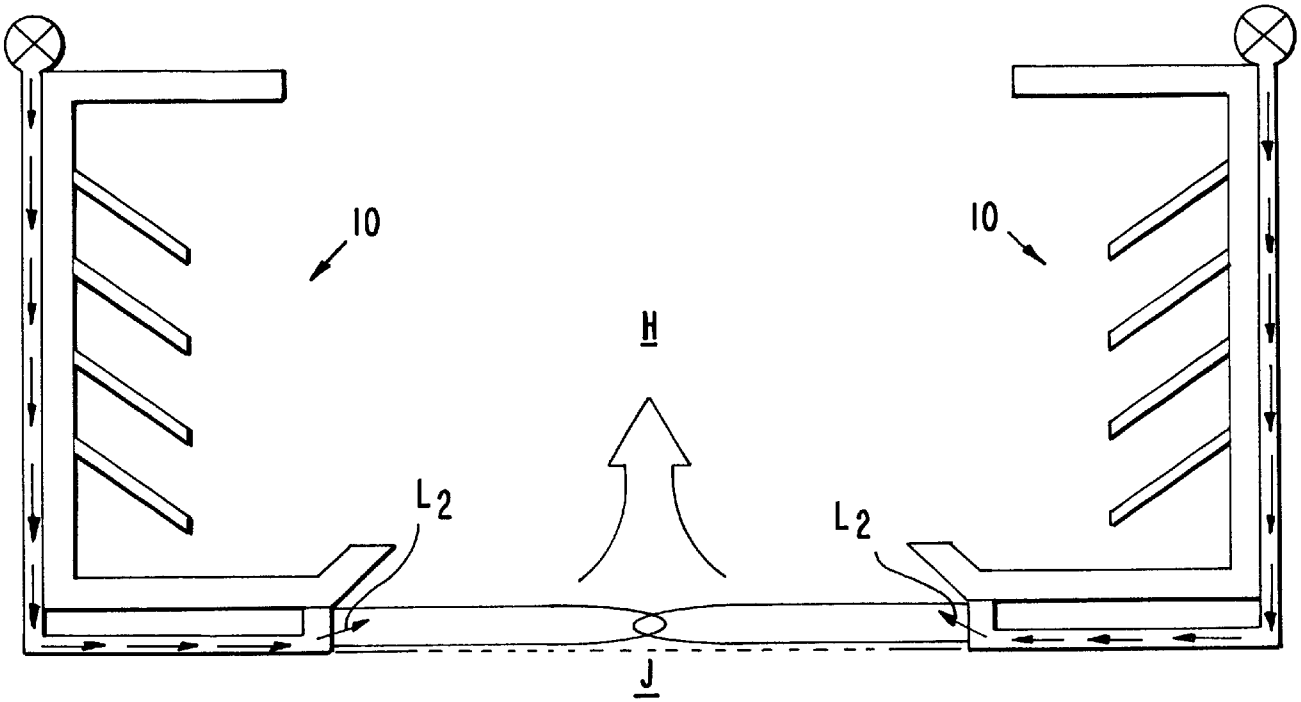
FIG. 5 illustrates a method in accordance with the invention in which warm air is passed from two trunk channels to the bottom parts of the display cases and in which the ejecting distances of the intake air are regulated by means of a nozzle construction as shown in FIGS. 4A and 4B so that the entire passage between the display cases is covered with warm air.

FIG. 5 shows an embodiment of the invention in which the air flows from opposite refrigerated display cases 10 are arranged so that the ejecting distance of each intake air flow $L_2$ covers one half of the width J of the passage between the display cases 10. Thus, the entire area of the passage J between the display cases 10 can be covered with warm air by regulating the slot nozzle 25 in accordance with FIGS. 4A and 4B provided at the ends of the channels 19 in the display cases 10.

Above, the invention has been described by way of example with reference to the figures in the accompanying drawing. The invention is, however, not confined to the exemplifying embodiments shown in the figures in the drawing alone, but different embodiments of the invention can show variation within the scope of the inventive idea defined in the accompanying patent claims.

We claim:

1. A method for using outdoor fresh ambient air to ventilate a space wherein said space includes at least one refrigerated display case, the method comprising the steps of:

directing an entire supply of ambient fresh air from an outdoor region into a trunk channel, said truck channel being structured and arranged to pass through a ceiling of the space and into a respective channel coupled to each of said at least one display case, and ejecting the ambient fresh air in each of the respective channels into the space from at least one location below each of the at least one display case such that the fresh air flows to a front side of each of the at least one display cases in a vicinity of a floor of the space.

2. The method of claim 1, further comprising the step of:

discharging air from a top portion of the space through an exhaust air valve.

3. The method of claim 1, further comprising the step of:

heating the fresh air in the channel.

4. The method of claim 1, further comprising the step of:

regulating a distance to which the fresh air is ejected from the channel into the space.

5. The method of claim 1, wherein the at least one display case comprises two display cases arranged opposite one another, further comprising the step of:

regulating a distance to which the fresh air is ejected from the channel in each of the display cases into the space such that the ejected fresh air extends effectively over an entire floor area between the display cases.

6. An air circulation system for using outdoor fresh ambient air to ventilate a space wherein said space includes at least one refrigerated display case, the system comprising:

a trunk channel structured and arranged to pass through a ceiling of the space for conducting an entire supply of fresh outdoor ambient air from a region exterior of said space into a region interior of said space;

a channel operably connected to said trunk channel for receiving said supply of fresh outdoor ambient air from said outdoor region, said channel being coupled to each of said at least one display case, and means for ejecting the fresh outdoor ambient air from the channel into the space from at least one location below the at least one display case such that fresh air flows to a front of each of the at least one display cases in a vicinty of a floor of the space.

7. The air circulation system of claim 6, further comprising heating means for heating air flowing in said channel.

8. The air circulation system of claim 6, further comprising regulation means arranged in said outlet opening for regulating flow of the air through said outlet opening.

9. The circulation system of claim 6, wherein said regulation means comprise at least one nozzle or valve arranged to regulate a distance to which the air is ejected from said channnel.

10. The air circulation system of claim 9, wherein said at least one nozzle or valve comprises a wing rim for directing the air into a vortex movement.

11. The air circulation system of claim 6, wherein said at least one nozzle or valve comprises a slot nozzle.

12. The air circulation system of claim 11, wherein said slot nozzle comprises a rotatable, eccentric regulator piece arranged in opposed relationship to a curved wall such that rotation of said regulator piece varies an opening between said regulator piece and said curved wall through which the air flows.

13. The air circulation system of claim 6, further comprising a heat exchanger adapted to transfer heat from a heat exchanger situated in a channel in the display case through which an air flow to be cooled passes.

14. The air circulation system of claim 6, wherein said channel has a vertically extending branch adapted to extend along a vertical wall of the display case and a horizontally extending branch adapted to extend below the display case.

15. The air circulation system of claim 14, wherein said blower is arranged at a top of said vertically extending branch.

16. An air circulation system for a refrigerated display case, comprising:

supply means adapted to be coupled to the display case, said supply means being structured and arranged for supplying fresh outdoor ambient air from an outdoor region exterior of a space in which said display case is disposed to a location in front of the display case, said supply means comprising a channel having an outlet opening adapted to be situated below the display case, and regulation means arranged in said outlet opening for regulating flow of the air through said outlet opening.

17. The air circulation system of claim 16, further comprising a blower adapted to be coupled to the display case for directing air to flow into said channel and out of said outlet opening of said channel.

* * * * *